United States Patent [19]

Baldwin

[11] 4,456,245

[45] Jun. 26, 1984

[54] ROTARY TORSO EXERCISE APPARATUS

[75] Inventor: Dan D. Baldwin, Independence, Va.

[73] Assignee: Nautilus Sports/Medical Industries, Inc., Lake Helen, Fla.

[21] Appl. No.: 329,882

[22] Filed: Dec. 11, 1981

[51] Int. Cl.[3] ..... A63B 21/06

[52] U.S. Cl. ..... 272/118; 272/134; 272/143

[58] Field of Search ..... 272/118, 117, 134, 143, 272/144, 93

[56] References Cited

U.S. PATENT DOCUMENTS 4,149,714 4/1979 Lambert ..... 272/118

4,296,924 10/1981 Anzaldua et al. ..... 272/117

FOREIGN PATENT DOCUMENTS 122994 8/1901 Fed. Rep. of Germany ..... 272/118

*Primary Examiner*—Richard J. Apley

*Assistant Examiner*—William R. Browne

*Attorney, Agent, or Firm*—Bell, Seltzer, Park & Gibson

[57] ABSTRACT

Apparatus and method for exercising torso rotation muscles of a person and in which a user's body is supported in a generally upright seated position, upper and lower torso portions are engaged so as to restrict movement of the user's body to rotary movement of the upper torso relative to the lower torso about an axis extending longitudinally of the user's body, and force is imposed to resist such movement.

3 Claims, 4 Drawing Figures

ROTARY TORSO EXERCISE APPARATUS

FIELD AND BACKGROUND OF INVENTION

Exercising undertaken by persons training for athletic events of various types of pursuing a course of treatment for the rehabilitation of an illness, injury or the like has, in recent years, come to involve the use of various apparatus or machines. Such apparatus, machines and methods have grown out of various concepts and studies regarding physiology and physiological development and function.

One type of apparatus and method which has been used with significant success is full range exercise such as is possible, for example, through the use of the apparatus of Jones U.S. Pat. No. 3,858,873. "Full range" exercise as used with reference to such an apparatus and method, and as used in the description which follows, is a defined term. The defined term "full range exercise" refers to exercise having positive work; negative work; rotary form movement; stretching; prestretching; automatically variable, balanced, direct resistance; resistance in the position of full muscular contraction; and substantially unrestricted speed of movement. The interested reader is referred to available publications for further explication of these characteristic features of full range exercise.

The general field of such exercise and related apparatus and methods is here referred to as "exercise physiology." The field of exercise physiology is related to sports medicine, being the field of medical study which is particularly directed to athletic sports and the like. The development of the field of exercise physiology has involved, among other things, the continuing development of apparatus and methods to accomplish precise application of exercising programs to specific muscles or muscle groups. One such muscle group is that which is associated with the torso rotation movement used in certain sports activities such as tennis and golf.

BRIEF DESCRIPTION OF INVENTION

It is an object of the present invention to accomplish exercising of torso rotation muscles. In realizing this object of the present invention, exercising apparatus is provided and has means for engagement with the body of a user. In particular, a user's upper and lower torso are engaged in such a manner that the muscles involved in torso rotation are essentially isolated and are exercised without substantial interaction with other muscle sets.

Yet a further object of the present invention is to accomplish exercising of torso rotation muscles of the user in accordance with a method by which rotary form movement of a user's torso occurs about an axis extending generally vertically through the user's body along a line passing through the user's body in general alignment with the spine. In accomplishing this object of the present invention, the upper torso and lower torso of the user's body are engaged and are restricted to movement thereof one relative to the other about the defined axis.

BRIEF DESCRIPTION OF DRAWINGS

Some of the objects of the invention having been stated, other objects will appear as the description proceeds, when taken in connection with the accompanying drawings, in which.

DETAILED DESCRIPTION OF INVENTION

While the present invention will be described more fully hereinafter with reference to the accompanying drawings, in which a preferred embodiment of the present invention is shown, it is to be understood at the outset of the description which follows that persons of skill in the appropriate arts may modify the invention here described while still achieving the favorable results of this invention. Accordingly, the description which follows is to be understood as being a broad, teaching disclosure directed to persons of skill in the appropriate arts, and not as limiting upon the present invention.

Referring now more particularly to the accompanying drawings, an apparatus for exercising torso rotation muscles in accordance with the present invention is there shown. The apparatus includes a frame structure preferably fabricated from steel tubing and generally indicated at 10. Mounted on the frame are means for supporting and engaging a user's body. In the illustrated form of the invention, the means for supporting and engaging a user's body includes lower torso engaging means generally indicated at 11 and taking the form of a seat and upper torso engaging means generally indicated at 12 and taking the form of a depending arm having hand grip frame means and an arm rest.

The lower torso engaging means, in the form illustrated, includes a seat 14 (FIGS. 1 and 2) mounted upon a pedestal 15 which is in turn supported on a base portion 16 of the frame 10. The seat has a central portion for supporting the buttocks of a user and a pair of oppositely directed horns which, together with hip pads, stabilize the lower torso position of a user of the apparatus of this invention. The user may sit in one of two positions, directed oppositely one relative to another and generally transversely of the apparatus. By such positioning, the user is subjected to a preload during exercising use of the apparatus. As an alternative, the seat may be mounted for rotation about the pedestal axis, with appropriate provision for locking into use position.

Figure 2:
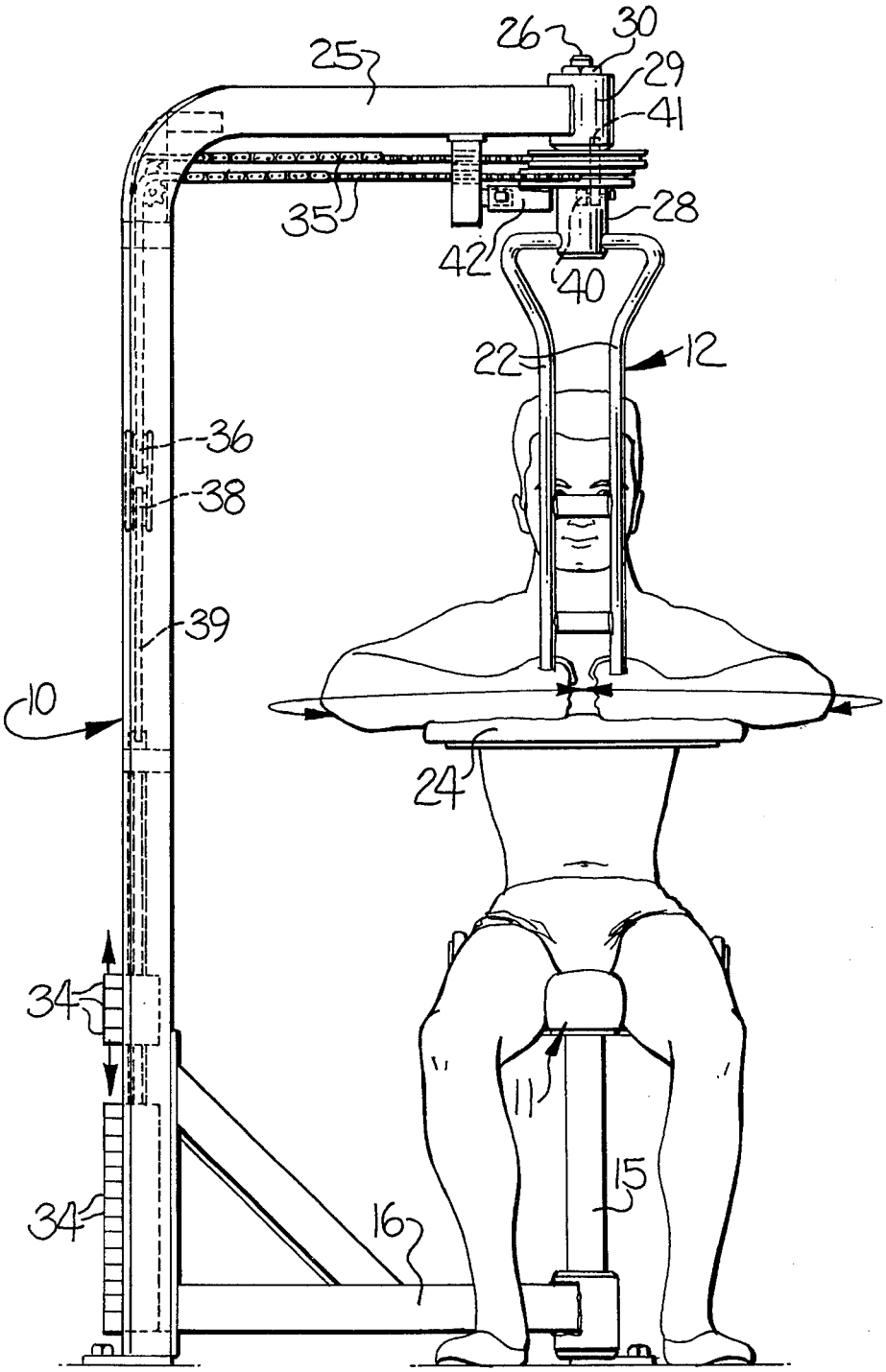
FIG. 2 is a side elevation view of the apparatus of FIG. 1, illustrating the orientation of a user during operation of the apparatus.

As will be understood particularly from reference to FIG. 2, the lower torso engaging means 11 positions the body of a user of the apparatus of this invention in upright seated position with the lower torso essentially restrained against rotational movement and with the torso aligned on a vertical axis generally parallel to the spine. The vertical axis extends through the pedestal 15 and through the body of a user. As brought out more fully hereinafter, restraint of the lower torso against movement and definition of an axis contribute to the accomplishment of exercise as contemplated by the present subject invention.

Figure 1:
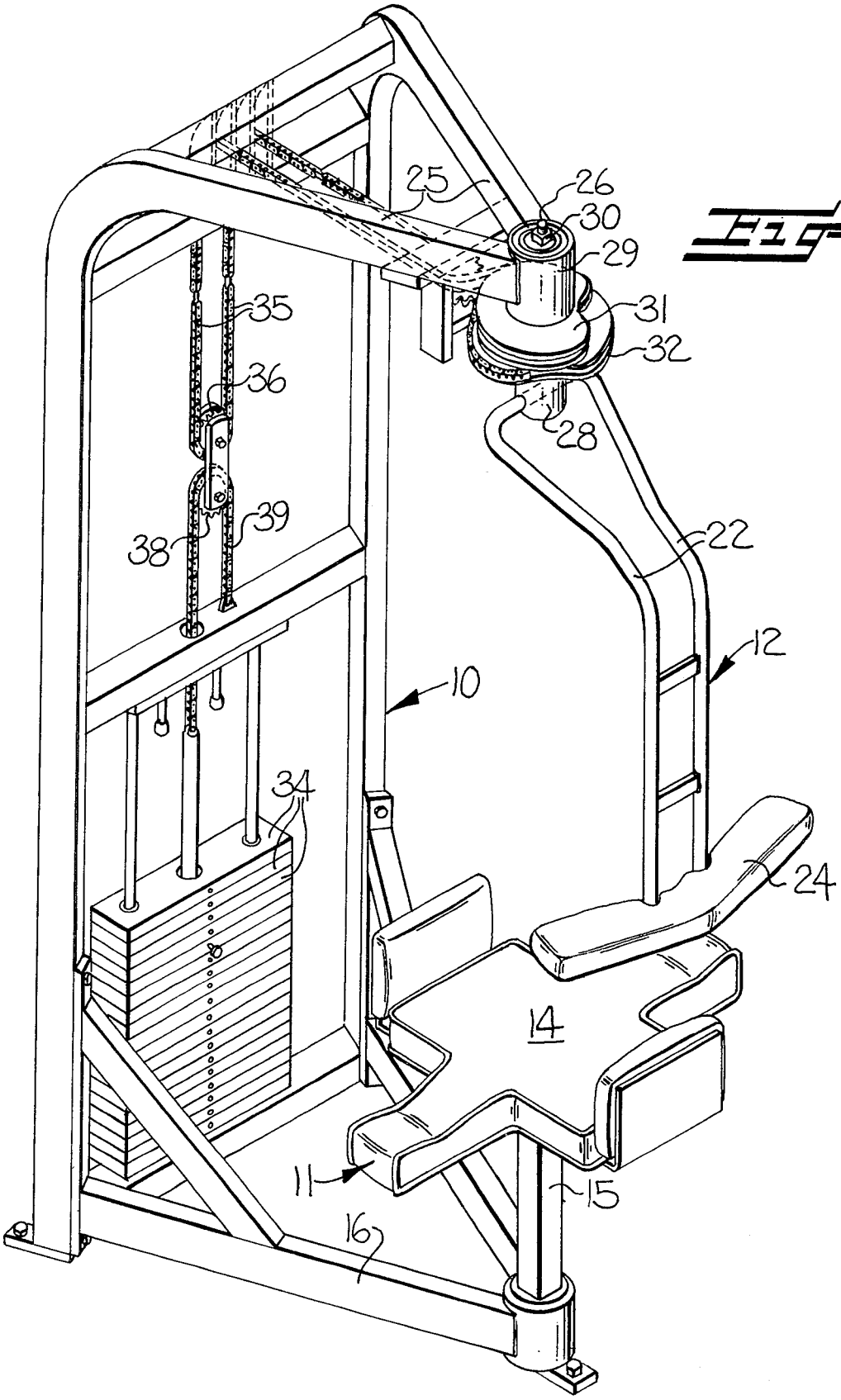
FIG. 1 is a perspective view of an exercise apparatus in accordance with the present invention.
Figure 3:
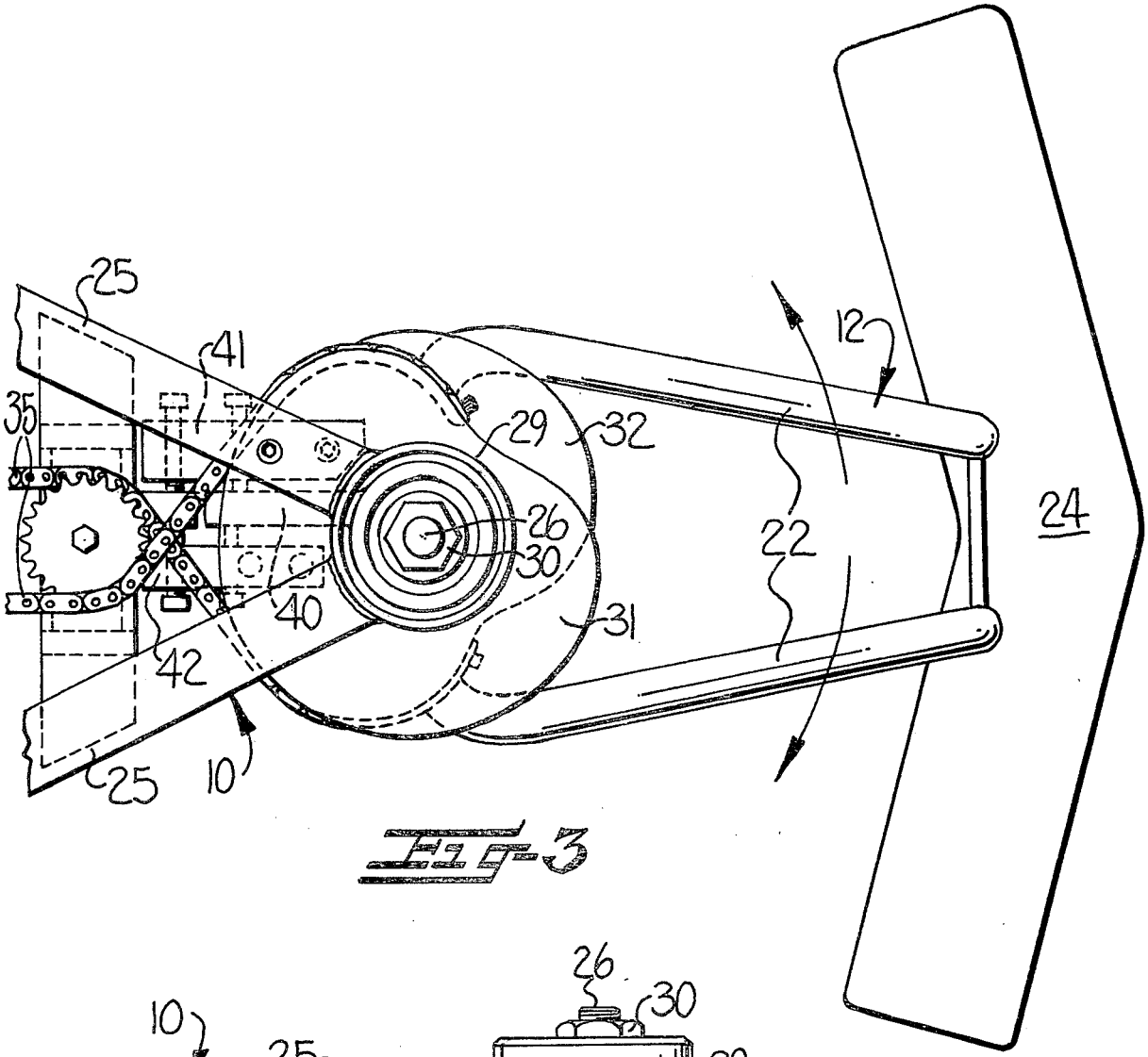
FIG. 3 is an enlarged plan view of the apparatus of FIGS. 1 and 2.

The upper torso engaging means 12 of the apparatus of the present invention is supported by mounting means which comprises a depending hand grip frame 22 having, at the lower end thereof, an armrest or elbow rest 24 which functions as the torso engaging means. The depending frame 22 is mounted from a cantilevered overhead frame portion 25 for rotation about an axis defined by a stub shaft 26 (FIGS. 3 and 4) mounted for rotational movement about the same axis as the pedestal 15. The stub shaft 26 preferably as formed is a reduced diameter portion of a mounting member 28 from which the hand grip frame 22 depends, and penetrates a bearing housing 29 secured to the cantilever frame portion 25. The stub shaft is secured in place by an appropriate nut 30 which holds elements of the apparatus of the present invention in assembled relation. By such mounting arrangement, the upper torso engaging means 12 may be rotated about the defined axis in either direction of movement from a neutral or centered position, as suggested by arrows in FIG. 3. The neutral or centered position is illustrated in FIGS. 1 and 3. In use, the upper torso engaging means 12 is rotated to a preload position as shown in FIG. 2.

Mounted on the stub shaft 26 for rotation relative thereto are a pair of cam members 31, 32. The cam members 31, 32 form portions of a resistance means provided in the apparatus of the present invention for imposing force resisting rotational movement of the upper torso engaging means relative to the lower torso engaging means. More specifically, linkage means are provided for operatively connecting the cam members 31, 32, which function as a variation means, with a weight means generally indicated at 34 and which is capable of imposing a gravitational load. The linkage means includes a looped chain 35 operatively connected at opposite ends thereof with the cam members 31, 32, and passing about an intermediate sprocket 36. The intermediate sprocket 36 is joined with a weight stack sprocket 38 which engages a weight stack chain 39. The weight stack chain 39 is, in turn, couplable with one or more weighting plates in a manner generally known to persons skilled in the arts of designing and building exercising apparatus.

Figure 4:
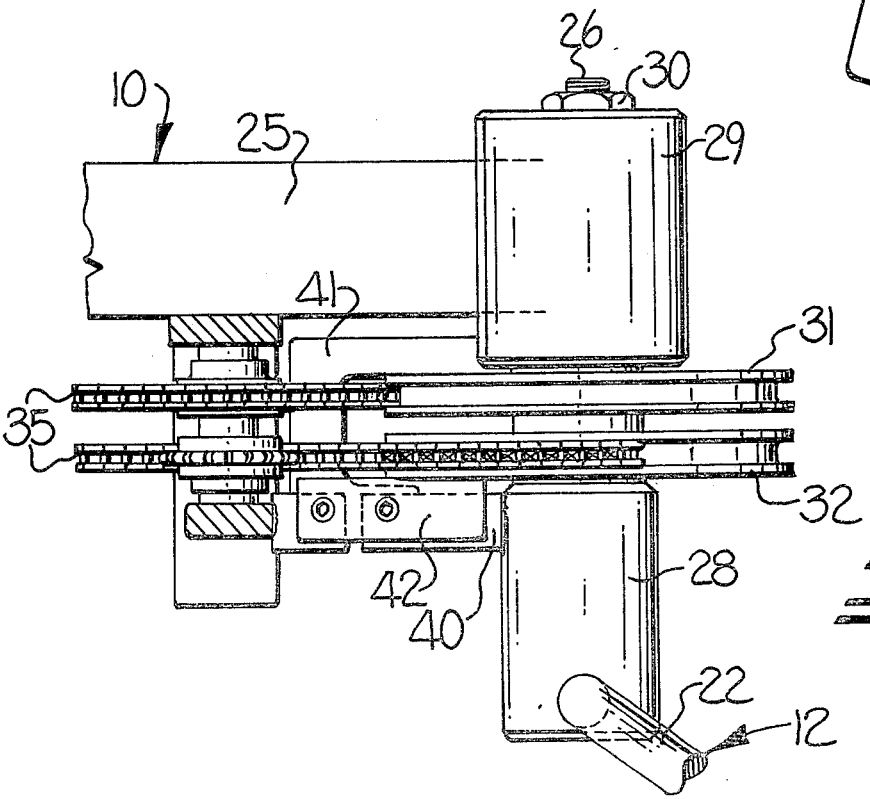
FIG. 4 is an enlarged elevation view of portions of the apparatus illustrated in FIG. 3.

The resistance means described generally above is operatively coupled with the upper torso body engaging means 12 through the provision of a radially projecting drive member 40 fixed to and rotating with the upper member 28. The driving projection 40 extends generally tangentially to the axis of the stub shaft 26 (FIG. 4). The drive member 40 is positioned between a pair of members 41, 42, each of which is secured to a corresponding one of the cams 31, 32. The cam attached members 41, 42 serve the dual functions of transmitting to the corresponding cam resistance forces resulting from the action of gravity on the weight stack 34 and preventing movement of one end of the chain 35. More particularly, upon rotation of the upper torso engaging means 12 in one direction (for example clockwise in FIG. 3), the driving projection 40 engages the member 41 fixed to one cam 31 and drives the cam 31 in rotation with the depending hand grip frame 22. Upon such rotation, which tensions the upper run of the chain 35 (as viewed in FIG. 4), the member 42 fixed to the other cam 32 engages a stationary stop member 44 which is fixed to the frame portion 25 which includes the bearing housing 29. Thus, the other cam 32 is restrained against rotation with the depending hand grip frame 22. Upon movement in a reverse direction (counterclockwise in FIG. 3), the reverse operation occurs.

As will be appreciated, movement of the weight stack 34 results in tensioning of the associated chain 35 to a known, predetermined and essentially uniform extent. By the provision of the cam members 31, 32, such tension is converted into a torque acting about the axis of movement of the upper torso engagement means 12. Preferably, cam members function as a variation means for varying the force imposed by the resistance means in accommodation of the body part demonstrable force curves achievable by a user of the machine, so as to facilitate full range exercise as mentioned hereinabove.

In use, a user wishing to develop the torso rotation muscles may select an appropriate weight to be imposed by the weight stack 34 and assume an exercising position in the apparatus (FIG. 2). The exercising position is one in which a preload toward a particular body position is imposed. That is, the position will be such that the upper torso engagement means 12 is rotated 90° from the essentially neutral position of FIGS. 1 and 3. As the exercising position is assumed, the user will support the arms upon the arm support portion 24 and grip the hand grip frame 22, essentially locking the upper torso portion including the shoulders into a particular attitude and position. Thereafter, the muscles of the body may be used to rotate the upper torso and shoulders relative to the lower torso and pelvic area, in a series of movements which essentially isolate the torso rotation muscle set. Movement of the apparatus is then dependent upon contraction of and extension of the torso rotation muscles, and subjects those muscles to full range exercise as defined hereinabove. During exercise, a portion of the depending frame functions as eye target for maintaining upper torso orientation. In completing an exercise sequence, a user will be seated for exercise first with a preload to one side, and then with a preload to the other side.

In the drawings and specification, there has been set forth a preferred embodiment of the invention, and although specific terms are employed, they are used in a generic and descriptive sense only and not for purposes of limitation.

That which is claimed is:

1. Apparatus for exercising torso rotation muscles and comprising means for supporting a user's body in a generally upright seated position and including upper torso engagement means having an arm rest and a hand grip portion and lower torso engagement means having a seat portion, means mounting said body supporting means for rotational movement of said upper torso engagement means relative to said lower torso engagement means about an axis extending longitudinally of a user's body along a line passing through the user's body adjacent and generally parallel to the spine, and resistance means operatively connected to said upper torso engagement means for imposing force resisting movement of said upper torso engagement means about said axis, said resistance means including first and second cam members each operative for imposing torque on said upper torso engagement means during rotational movement of said upper torso engagement means in a corresponding one of first and second rotational directions about said axis, and wherein said first and second cam members comprise variation means for changing the amount of force imposed in predetermined relationship to rotation of said upper torso engagement means, said resistance means cooperating with said body supporting means for imposing a preload on a user's body, and further wherein said resistance means further comprises means for selectively operatively coupling said first and second cam members to said upper torso engagement means during rotation thereof in said corresponding directions and for selectively operatively blocking rotation of said first and second cam members during rotation of said upper torso engagement means in directions opposite to said corresponding one direction, said body supporting means and said mounting means cooperating for restricting movement of a user's body during exercise to rotary movement about said axis and for isolating the torso rotation muscles of the user's body and for exercising such muscles against the force imposed by said resistance means.

2. Apparatus for exercising torso rotation muscles and comprising means for supporting a user's body in a generally upright seated position and including upper torso engagement means having an arm rest and a hand grip portion and lower torso engagement means having a seat portion for orienting the user's body to face in a predetermined direction, means mounting said body supporting means for rotational movement of said upper torso engagement means relative to said lower torso engagement means about an axis extending longitudinally of a user's body along a line passing through the user's body adjacent and generally parallel to the spine, first and second cam members for imposing torque on said upper torso engagement means during rotational movement of said upper torso engagement means in a corresponding one of first and second rotational directions about said axis, said cam members imposing torques which vary as functions of the rotational position of said upper torso engagement means, and coupling means for selectively operatively connecting said cam members with said upper torso engagement means during rotation thereof in said corresponding directions and for selectively operatively blocking rotation of said cam members during rotation of said upper torso engagement means in directions opposite to said corresponding one direction, said cam members and said coupling means cooperating for biasing said upper torso engagement means toward a neutral position at a right angle of rotation from said predetermined direction in which a user's body is oriented and for thereby imposing a preload on a user's body, said supporting means and said mounting means cooperating for restricting movement of a user's body during exercise to rotary movement about said axis and for isolating the torso rotation muscles of the user's body and for exercising such muscles against the torque imposed by said cam members.

3. Apparatus according to claim 2 wherein said seat portion is configured for orienting the user's body in one of two oppositely facing predetermined directions, both at a right angle of rotation from said neutral position of said upper torso engagement means for accommodating alternate directions of preload.

* * * * *